US010774452B2

(12) United States Patent
Tremblay

(10) Patent No.: US 10,774,452 B2
(45) Date of Patent: Sep. 15, 2020

(54) THREAD STORAGE AND DISPENSING SEWING ASSEMBLY

(71) Applicant: Christian Tremblay, Trois-Rivières (CA)

(72) Inventor: Christian Tremblay, Trois-Rivières (CA)

( * ) Notice: Subject to any disclaimer, the term of this patent is extended or adjusted under 35 U.S.C. 154(b) by 80 days.

(21) Appl. No.: 16/035,558

(22) Filed: Jul. 13, 2018

(65) Prior Publication Data

US 2019/0040559 A1 Feb. 7, 2019

Related U.S. Application Data

(60) Provisional application No. 62/540,778, filed on Aug. 3, 2017.

(51) Int. Cl.
*D05B 91/16* (2006.01)
*D05B 87/00* (2006.01)

(52) U.S. Cl.
CPC ..... *D05B 91/16* (2013.01); *D05B 87/00* (2013.01)

(58) Field of Classification Search
CPC .. D05B 91/00–16; D05B 87/00; D05B 97/00; B65H 49/00; B65H 49/18; B65H 49/16; B65H 49/04; B65H 49/32; B65H 15/02; B65H 15/06; B65H 57/00; B65H 57/04; B65H 57/16; B65H 57/18; B65D 57/00; B65D 85/04; A41H 31/00; A47N 53/00; Y10T 225/20; Y10T 225/298; Y10S 312/902; Y10S 206/00; Y10S 206/814
See application file for complete search history.

(56) References Cited

U.S. PATENT DOCUMENTS

| | | | | | |
|---|---|---|---|---|---|
| 718,804 | A * | 1/1903 | Watson | D05B 91/14 | 223/107 |
| 1,725,368 | A * | 8/1929 | Port | D05B 91/14 | 223/107 |
| 1,881,700 | A * | 10/1932 | Laing | D05B 91/14 | 223/107 |
| 2,148,860 | A * | 2/1939 | Huber | D05B 91/14 | 242/137 |
| 2,432,914 | A * | 12/1947 | MacKay | D05B 91/14 | 223/106 |
| 2,437,888 | A * | 3/1948 | Narki | D05B 91/14 | 225/38 |
| 2,564,949 | A * | 8/1951 | Bell | D05B 91/12 | 223/107 |
| 2,673,669 | A * | 3/1954 | Hawkins | D05B 91/14 | 223/107 |

FOREIGN PATENT DOCUMENTS

CA 2923693 9/2017

* cited by examiner

*Primary Examiner* — Ismael Izaguirre
(74) *Attorney, Agent, or Firm* — Bereskin & Parr LLP/S.E.N.C.R.L., s.r.l.

(57) ABSTRACT

There is provided a sewing assembly that comprises a plurality of pins for receiving spools of thread, a plurality of thread cutters and retainers adjacent an extremity of the container, a plurality of slots located therebetween, and a needle threader. Thread unwound from a thread spool and received within a respective slot is cut by pressing the unwound thread at a desired length within a respective thread cutter so as to cut the unwound thread and simultaneously retain uncut thread within a respective thread retainer.

16 Claims, 10 Drawing Sheets

THREAD STORAGE AND DISPENSING SEWING ASSEMBLY

CROSS-REFERENCE TO RELATED APPLICATIONS

The present disclosure claims the benefit of priority from U.S. provisional application No. 62/540,778 filed on Aug. 3, 2017. This document is hereby incorporated by reference in its entirety.

FIELD OF THE DISCLOSURE

The present disclosure relates to sewing equipment and more particularly to a sewing assembly for storing and dispensing thread.

BACKGROUND OF THE DISCLOSURE

Sewing boxes for storing sewing accessories including thread spools are known. Such sewing boxes are useful in organizing the spools and for dispensing thread. A drawback of these sewing boxes is that unwound thread often becomes loose on the spool and becomes tangled with other thread. Some sewing boxes further comprise cutting means for cutting the thread, however a drawback of these cutting means is that the strands of thread remain tangled.

SUMMARY OF THE DISCLOSURE

It would be thus highly desirable to be provided with a sewing assembly that would at least partially address the disadvantages of existing sewing boxes.

According to an aspect of the present disclosure, there is provided a sewing assembly, comprising:

- a container comprising a compartment having a plurality of pins for receiving spools of thread;
- a plurality of thread cutters adjacent an extremity of the container;
- a plurality of slots located therebetween, each slot being configured to receive therethrough unwound thread from one of the spools of thread, and to align the unwound thread towards a respective thread cutter; and
- a needle threader connected to the container,
- wherein the unwound thread received in a respective slot is cut by pressing the unwound thread at a desired length within a respective thread cutter so as to cut the unwound thread and simultaneously retain uncut thread within the respective thread cutter.

By using the sewing assembly of the present disclosure, the user may conveniently store, dispense and cut thread from a plurality of spools while ensuring that the loose end of the cut thread does not tangle with other thread or be pulled back towards the spool.

BRIEF DESCRIPTION OF THE DRAWINGS

In the following figures, which represent by way of example only, various embodiments of the disclosure.

DETAILED DESCRIPTION OF THE DISCLOSURE

Figure 1:
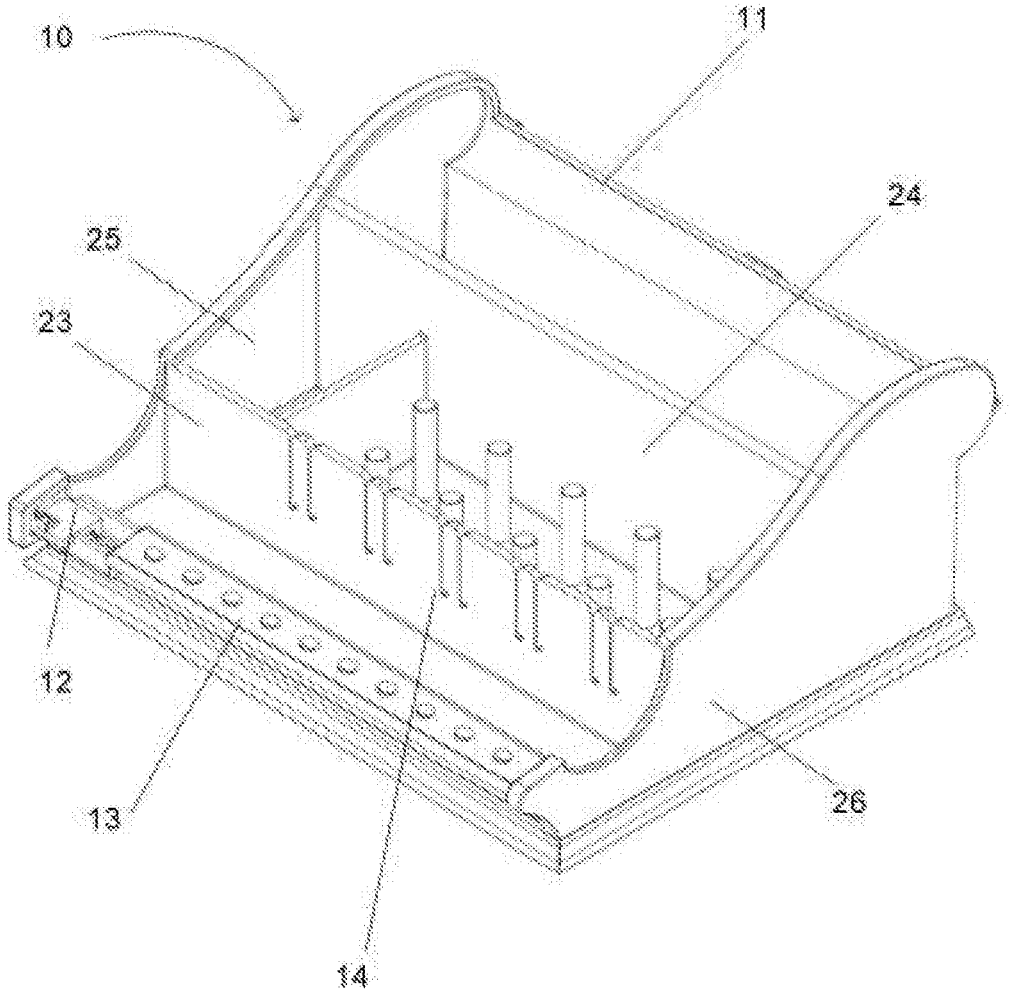
FIG. 1 is a perspective view of the sewing assembly according to an exemplary embodiment.
Figure 2:
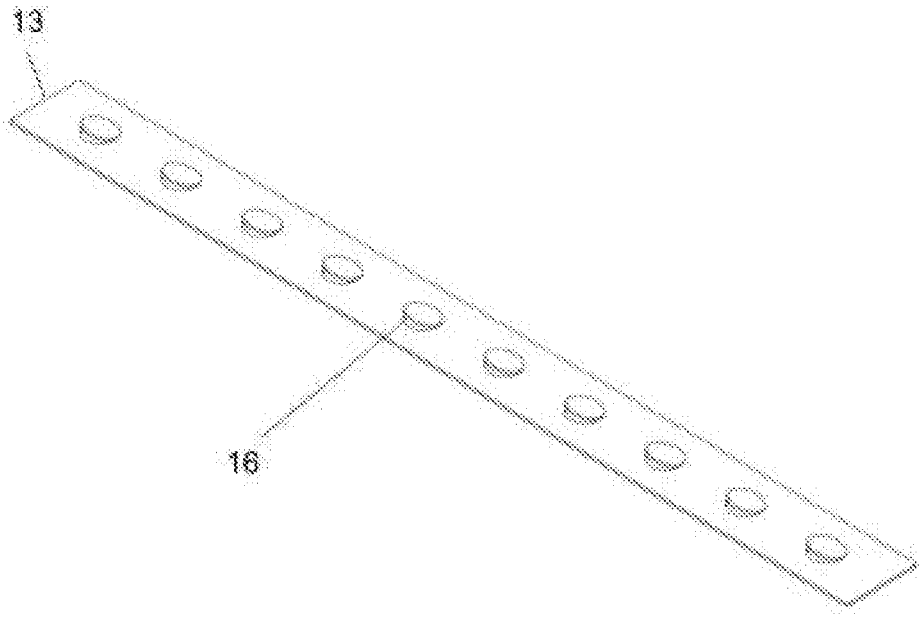
FIG. 2 is an isolated perspective view of the strip for cutting and retaining thread of the sewing assembly shown in FIG. 1.

As used in this specification and the appended claims, the singular forms "a", "an" and "the" include plural references unless the content clearly dictates otherwise. It should also be noted that the term "or" is generally employed in its sense including "and/or" unless the content clearly dictates otherwise.

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms "including", "having" and their derivatives.

Finally, terms of degree such as "substantially", "about" and "approximately" as used herein mean a reasonable amount of deviation of the modified term such that the end result is not significantly changed. These terms of degree should be construed as including a deviation of ±10% of the modified term if this deviation would not negate the meaning of the word it modifies.

The definitions and embodiments described in particular sections are intended to be applicable to other embodiments herein described for which they are suitable as would be understood by a person skilled in the art.

For example, the container further comprises a plurality of thread retainers, optionally aligned with the plurality of thread cutters. For example, the plurality of thread retainers is positioned between the plurality of thread cutters and the plurality of slots.

For example, the container is defined by a surface and by a pair of sidewalls.

For example, the container further comprises a partition wall defining the plurality of slots.

For example, an anti-skid coating can be applied onto the slots, or at least to the portion of the slots that retains the thread therein, to further increase friction between the thread and the slot, and maintain alignment of the thread with respect to the spool and the thread retainer and thread cutter. For example, the anti-skid coating is an anti-skid sheet, paint or spray. For example, the anti-skid coating comprises an elastomer.

For example, the partition wall is secured between the pair of sidewalls.

For example, the partition wall is positioned at an angled relative to the pair of sidewalls. For example, the partition wall is perpendicular relative to the pair of sidewalls.

For example, the thread retainers and the thread cutters are made of the same material.

For example, an anti-skid coating can be applied onto the thread retainers and thread cutters. For example the same anti-skid coating applied onto the slots can be applied onto the thread retainers and thread cutters. For example, the anti-skid coating is applied on the underside of the tongues only. Such an anti-skid coating increases friction between the thread and thread retainer and between the thread and thread cutter, thus further maintaining the unwound threads taut and straight, and facilitating cutting and retaining of thread. For example, the anti-skid coating is an anti-skid sheet, paint or spray. For example, the anti-skid coating comprises an elastomer. It will be understood that the anti-skid coating is sufficiently thin so as not hinder the ability of the sharp edges of the thread cutter tongues to cut thread.

For example, a plurality of thread cutters and retainers is mounted on a strip.

For example, the needle threader is mounted, optionally pivotably mounted to the container and movable between a storage position and an operational position.

For example, the needle threader in the operational position is retained by a portion of the sidewall.

For example, the needle threader is connected to the extremity of the container, adjacent the plurality of thread cutters and retainers.

The following examples are non-limitative and are used to better exemplify the materials and processes of the present disclosure.

EXAMPLES

Referring now to the exemplary figures, the sewing assembly 10 comprises a container 11 for storing sewing accessories including spools of thread, as well as thread cutters 16, optionally thread retainers 15, and a needle threader 12.

Figure 3:
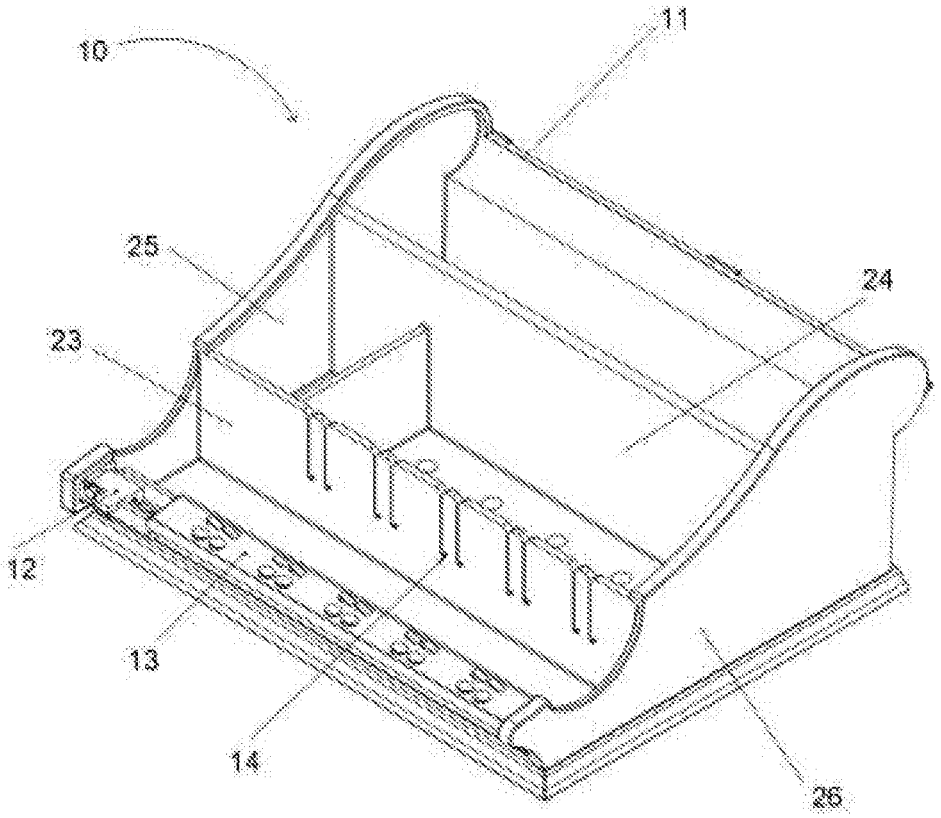
FIG. 3 is a perspective view of the sewing assembly according to an alternative embodiment.
Figure 7:
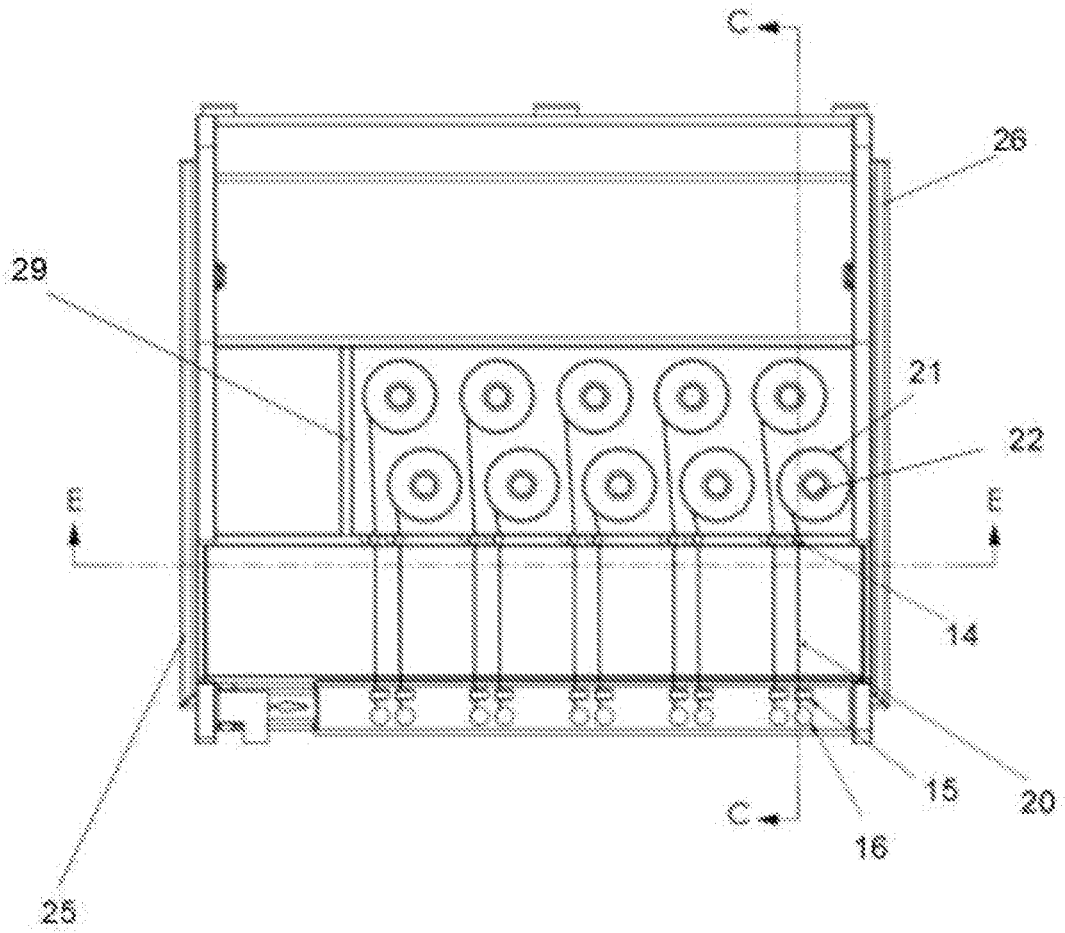
FIG. 7 is a top plan view of the sewing assembly of FIG. 3.

With reference to FIGS. 1, 3 and 7, the container 11 comprises compartments defined by a base, sidewalls 25, 26, and partition walls 23, 24 and 29. In particular, one of the compartments is configured to store a number of spools of thread 21. This compartment is separated by a sidewall 26 and by partition walls 23, 24 and 29. Other compartments comprised in the container 11 may be used to store other sewing accessories, for example and without limitation needles, pins, scissors, thimble and buttons.

Figure 8:
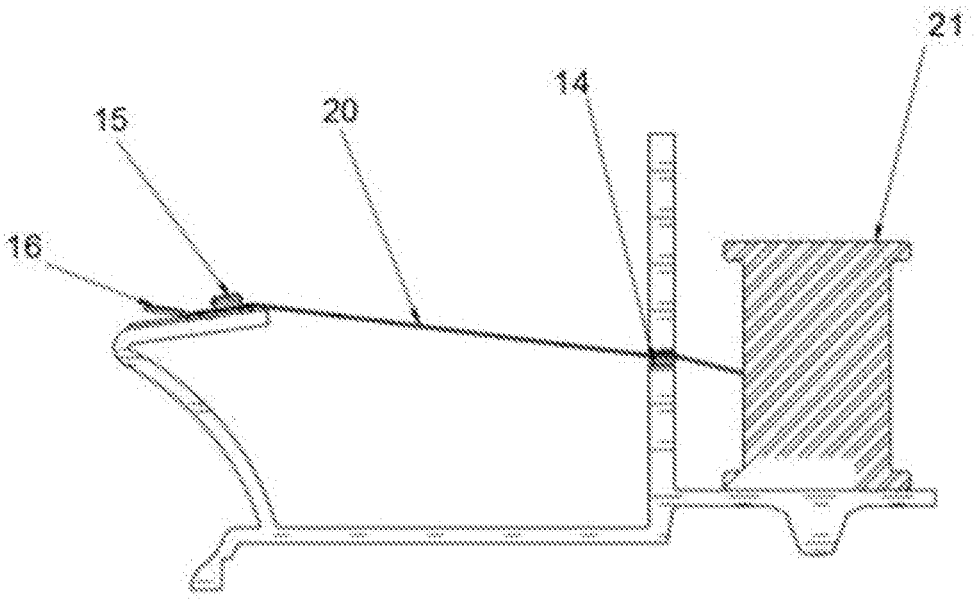
FIG. 8 is partial sectional view along the line C-C of FIG. 7.
Figure 9:
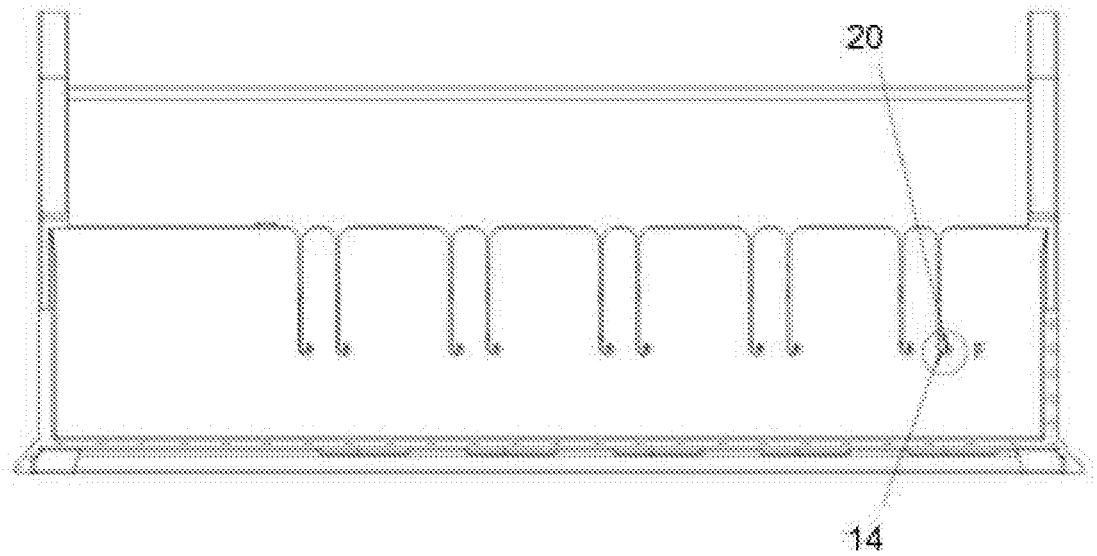
FIG. 9 is a partial sectional view along the line E-E of FIG. 7.
Figure 10:
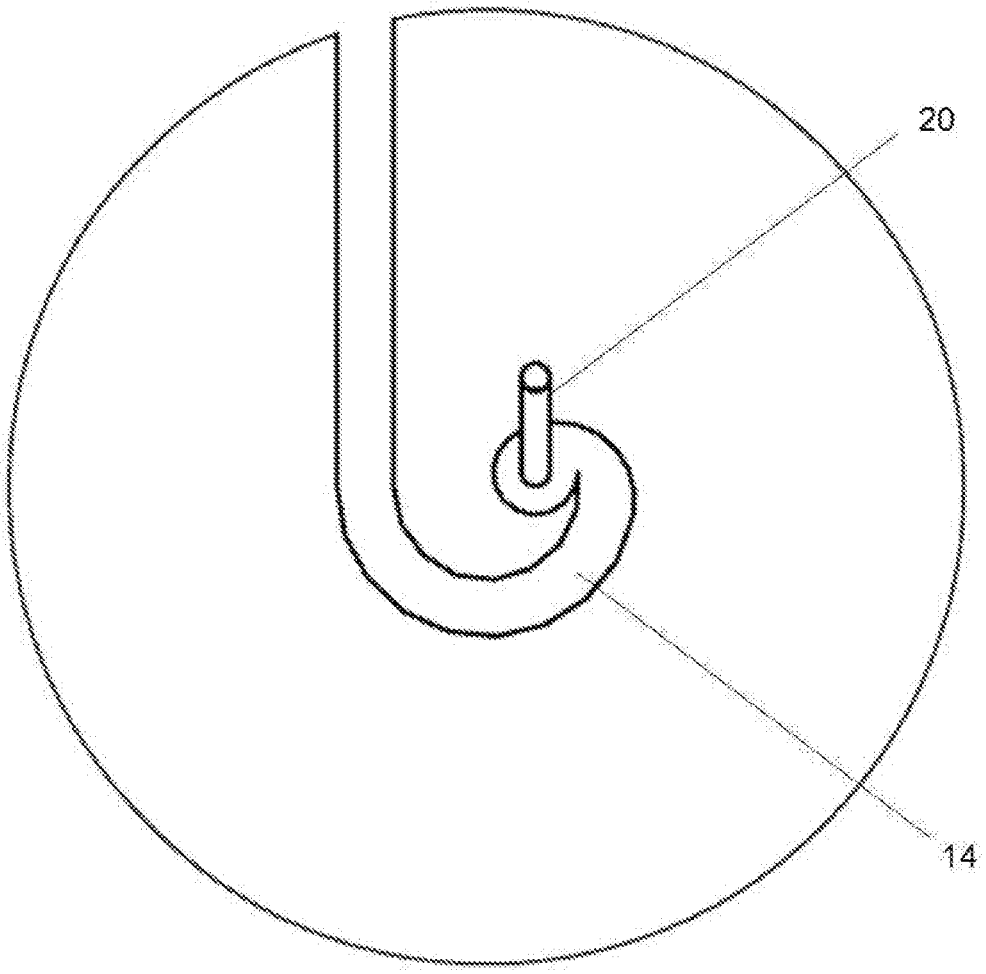
FIG. 10 is a close-up view of a slot defined in the partition of the sewing assembly shown in FIG. 9.

Referring now to FIGS. 7 and 8, the spools of thread 21 are retained in an upstanding position by means of pins 22 extending vertically from the base of the container 11. Each pin 22 can be inserted into a central bore of the spool 21 and the spool can be readily removed from the pin by sliding it off the outer extremity of the pin. In this present example two rows of five pins 22 are located equidistant from each other. In this configuration, once the threads from the plurality of spools are unwound and pulled toward the plurality of thread cutters 16, the threads from the plurality of spools will not be tangled together. It will be understood that other pin configurations may be contemplated and more or fewer pins may be included in the sewing assembly so long as the unwound thread from different spools remains untangled. For example, as shown in FIG. 7, the portions of unwound thread exiting each slot 14 and being retained by each corresponding thread retainer 15 and thread cutter 16 are substantially parallel to one another.

Referring now to FIGS. 1, 7 and 8, the partition wall 23 comprises a plurality of slots 14 for aligning strands of thread dispensed from the spools 21. For example, the number of slots corresponds to the number of pins for retaining the spools. In a non-limiting example, the partition wall 23 comprises ten slots 14. Referring now to FIGS. 1, 3, 9 and 10, the slots 14 are shaped as a letter "J". In this particular configuration, the thread 20 passing through the slot is hooked onto an inner extremity of the slot 14, thus maintaining alignment of the thread 20. It will be appreciated that other slot configurations may be contemplated so long as the thread remains retained in the slot.

Figure 4:
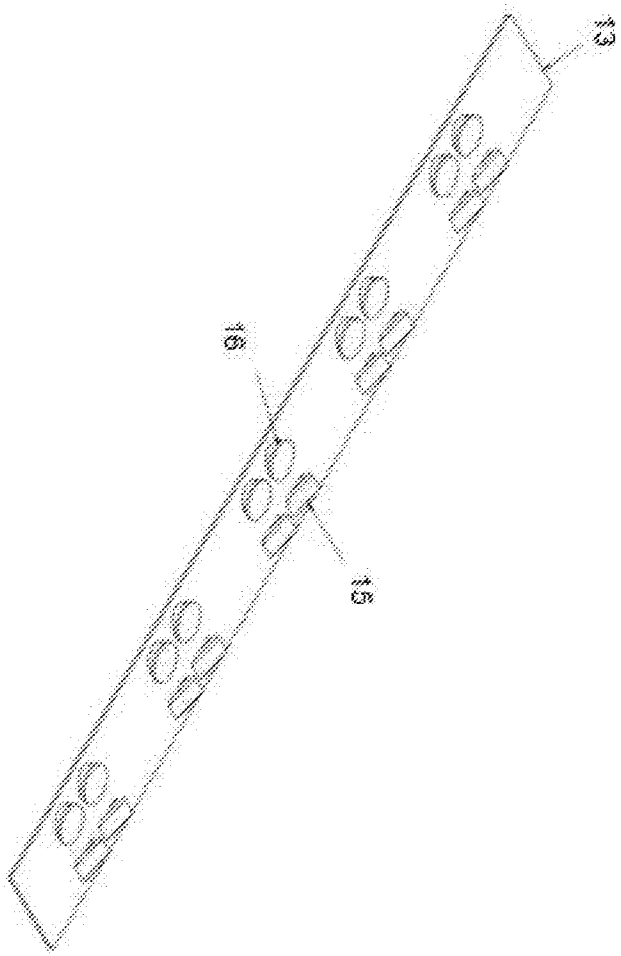
FIG. 4 is an isolated perspective view of the strip for cutting and retaining thread of the sewing assembly shown in FIG. 3.

With reference to FIGS. 1, 2, 3, 4 and 7, the assembly 10 also comprises a strip 13 for cutting and retaining thread 20 unwound from a spool 21. The strip 13 is attached at an extremity of the container 11. The strip in FIGS. 1 and 2 comprises a plurality of thread cutters 16. In an alternative embodiment, as shown in FIGS. 3, 4 and 7, the strip comprises a plurality of thread cutters 16 and a plurality of thread retainers 15. For example, each thread cutter 16 is aligned with each slot (not shown). Thread cutters 16 alone are effective for both cutting and retaining the thread. Adding thread retainers may further increase retention and tautness of the unwound thread. Referring specifically to FIGS. 3, 4 and 7, the strip 13 comprises pairs of spaced apart thread retainer 15 and thread cutter 16. For example, the number of pairs of spaced apart thread retainer and cutter corresponds to the number of pins and/or slots. The thread cutter 16 is nearest to the edge of the container 11 while the thread retainer 15 is positioned between the thread cutter and the partition wall 23. For example, the strip 13 is formed of a first row of a plurality of thread cutters 16 (adjacent to the edge of the container) and a second row of a plurality of thread retainers 15. For example, each thread cutter 16 and each thread retainer 15 is aligned with each slot 14.

The thread cutters and thread retainers can for example be made of the same material. It will be appreciated that any suitable material that can cut and retain thread may be used to make the thread cutters and retainers. For example, the thread cutters and retainers can be made of a metal such as aluminum. For example, as shown in FIGS. 1, 2, 3, 4 and 7, the thread retainers and cutters are integrated into the strip 13. The thread retainers and cutters can be formed using known methods, for example by perforating or punching out the underside of the strip to form a plurality of tongues extending outwardly from the upper surface of the strip at an angle (for example at 10°, 20°, 30°, 40°, 50°, or 60°).

The thread cutter 16 shown in FIGS. 1, 2, 3, 4 and 7 comprises a flat circular tongue extending outwardly from the strip 13 at one end and being connected to the strip surface at another end. This configuration allows formation of a notch or wedge in which the thread can be inserted as well as sharp edges around the tongue for cutting the thread. It will be understood that other thread cutters that are adapted to cut thread may be used. Similarly, the thread retainer 15 shown in FIGS. 3, 4 and 7 comprises a flat rectangular tongue extending outwardly from the strip at one end and being connected to the strip surface at another end. This configuration also allows formation of a notch or wedge, where the tongue and strip surface meet, in which the thread can be retained once it is cut. Other known thread retainers may be envisaged.

In operation, the user secures a spool of thread 21 over a pin 22, unwinds a strand of thread and pulls it toward the strip 13. The thread 20 is passed through the partition wall 23 and inserted into a slot 14 that is substantially aligned with the pin 22. The thread 20 confined in the slot 14 is pulled toward the strip 13 and once a desired thread length is obtained, the user inserts the thread into the notch of the thread cutter 16 and presses the thread against an edge of the thread cutter so as to cut the thread and retain it in the thread cutter 16. When a thread retainer 15 is included in the assembly, cutting the thread using the thread cutter 16 simultaneously causes a thread portion to frictionally engage the notch of the thread retainer 15 and become wedged therein and thus further retained. The different threads unwound from the plurality of spools thus remain aligned and several threads may be used, for example up to ten different threads, without getting tangled together. In addition, the thread retainer 15 effectively retains a thread extremity which prevents the thread from being pulled back towards the spool. The thread retainers 15 also maintain the unwound threads taut and straight which facilitates further unwinding and cutting of thread.

Figure 5:
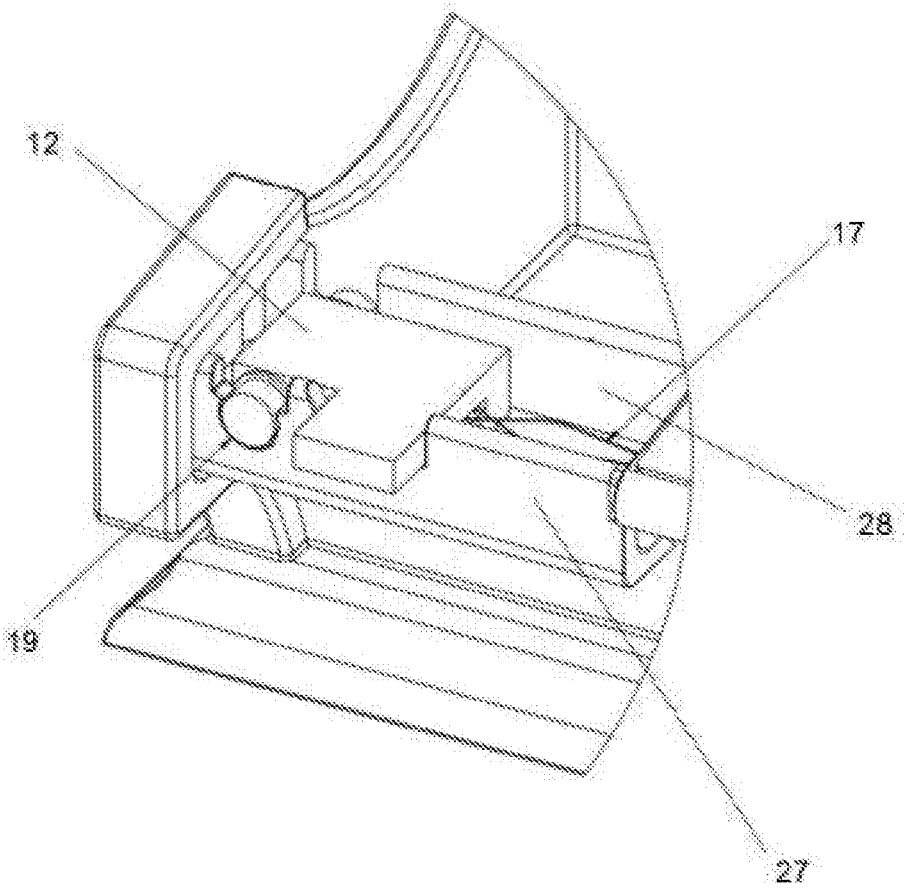
FIG. 5 is an isolated perspective view of the needle threader in a folded configuration comprised in the sewing assembly shown in FIG. 1 or 3.
Figure 6:
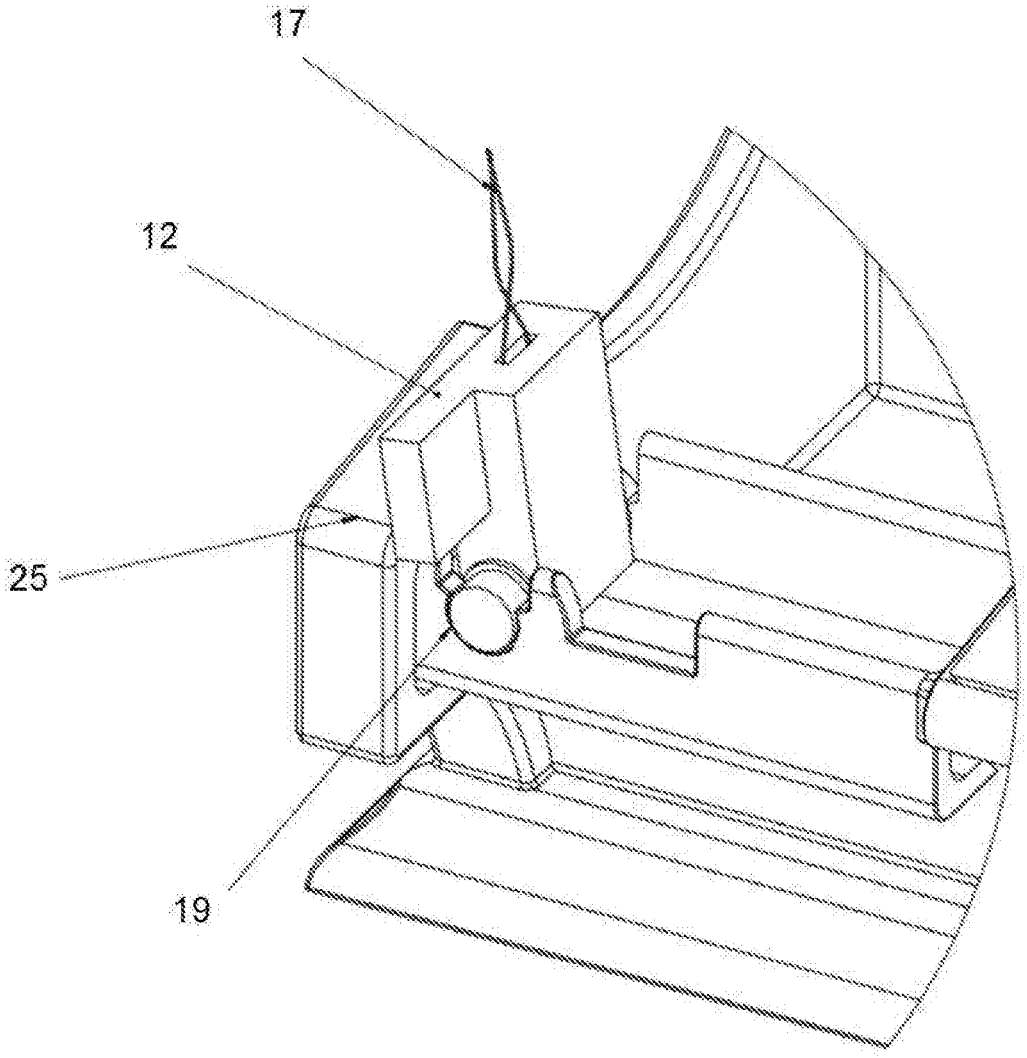
FIG. 6 is an isolated perspective view of the needle threader in a deployed configuration comprised in the sewing assembly shown in FIG. 1 or 3.

As can be seen in FIGS. 1, 3 5 and 6, the sewing assembly 10 further comprises a needle threader 12. In these examples, the needle threaded is pivotally mounted to the container 11 by way of a pivot 19 and movable between a folded configuration, as shown in FIG. 5, and a deployed configuration, as shown in FIG. 6. In the folded configuration, the delicate threading portion 17 of the needle threader is protected between a pair of protection walls 27 and 28, and in the deployed configuration the needle threader 12 rests upon a portion of the sidewall 25 and is ready for use.

The needle threader 12 may be placed anywhere on the container 11. As exemplified in FIGS. 1, 3, 5, 6 and 7, it is placed conveniently at an extremity of the container 11 to be readily accessible. In use, the threading portion 17, which is made for example of thin metal wire, is inserted into the eye of a needle. A thread strand is inserted into the loop of the threading portion and when the needle is removed from the threading portion, the thread is pulled through the eye of the needle. It will be understood that other suitable needle threaders may be used in the present sewing assembly. It will be also understood that the needle threader can be positioned elsewhere on the container, for example to the right hand side of the assembly.

The assembly is compact and readily portable. The container may be made of any suitable material, for example, plastic, wood, metal. The assembly may also be covered by a lid.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

What is claimed is:

1. A sewing assembly, comprising:

a container comprising a compartment having a plurality of pins for receiving spools of thread;

a plurality of thread cutters adjacent an extremity of the container;

a plurality of slots located therebetween, each slot being configured to receive therethrough unwound thread from one of the spools of thread, and to align the unwound thread towards a respective thread cutter; and a needle threader integrated with the container, wherein the unwound thread received in a respective slot is cut by pressing the unwound thread at a desired length within a respective thread cutter so as to cut the unwound thread and simultaneously retain uncut thread within the respective thread cutter.

2. The assembly of claim 1, further comprising a plurality of thread retainers positioned between the plurality of thread cutters and the plurality of slots.

3. The assembly of claim 1, wherein the container is defined by a surface and by a pair of sidewalls.

4. The assembly of claim 3, wherein the container further comprises a partition wall defining the plurality of slots.

5. The assembly of claim 4, wherein the partition wall is secured between the pair of sidewalls.

6. The assembly of claim 5, wherein the partition wall is at an angle relative to the pair of sidewalls.

7. The assembly of claim 2, wherein the plurality of thread retainers and the plurality of thread cutters are integrated on a strip.

8. The assembly of claim 2, wherein the plurality of thread retainers and thread cutters is mounted on a strip.

9. The assembly of claim 1, wherein the plurality of thread cutters comprises an anti-skid coating.

10. The assembly of claim 2, wherein the plurality of thread retainers comprises an anti-skid coating.

11. The assembly of claim 1, wherein the needle threader is mounted, optionally pivotably mounted, to the container and movable between a storage position and an operational position.

12. The assembly of claim 1, wherein the needle threader is connected to the container, adjacent the plurality of thread retainers and thread cutters.

13. The assembly of claim 1, wherein the plurality of slots comprises an anti-skid coating.

14. The assembly of claim 1, wherein the needle threader is integrated with the container adjacent to the plurality of thread cutters.

15. The assembly of claim 1, wherein the needle threader is pivotably mounted to the container.

16. The assembly of claim 15, wherein the needle threader is pivotably movable between a storage position and an operational position.

* * * * *